US010975551B2

(12) United States Patent
Uji et al.

(10) Patent No.: US 10,975,551 B2
(45) Date of Patent: Apr. 13, 2021

(54) CONSTRUCTION MACHINE

(71) Applicant: HITACHI CONSTRUCTION MACHINERY CO., LTD., Tokyo (JP)

(72) Inventors: Katsumasa Uji, Tsukuba (JP); Yuichiro Morita, Hitachi (JP); Kouichi Shibata, Kasumigaura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 226 days.

(21) Appl. No.: 16/080,682

(22) PCT Filed: Feb. 28, 2017

(86) PCT No.: PCT/JP2017/007998
§ 371 (c)(1),
(2) Date: Aug. 29, 2018

(87) PCT Pub. No.: WO2018/051536
PCT Pub. Date: Mar. 22, 2018

(65) Prior Publication Data

US 2019/0017249 A1 Jan. 17, 2019

(30) Foreign Application Priority Data

Sep. 16, 2016 (JP) ..... JP2016-182208

(51) Int. Cl.
*E02F 9/26* (2006.01)
*E02F 3/43* (2006.01)
*G07C 5/02* (2006.01)

(52) U.S. Cl.
CPC ..... *E02F 9/261* (2013.01); *E02F 3/435* (2013.01); *G07C 5/02* (2013.01)

(58) Field of Classification Search
CPC . E02F 9/261; E02F 9/262; E02F 3/435; E02F 3/438
See application file for complete search history.

(56) References Cited

U.S. PATENT DOCUMENTS 6,542,514 B1 * 4/2003 Yamada ..... H04L 12/1881 370/390
8,965,642 B2 * 2/2015 Johnson ..... E02F 3/32 701/50

(Continued)

FOREIGN PATENT DOCUMENTS

JP 2002-108975 A 4/2002
JP 2005-011058 A 1/2005

(Continued)

OTHER PUBLICATIONS

International Search Report of PCT/JP2017/007998 dated May 23, 2017.

(Continued)

*Primary Examiner* — Behrang Badii
*Assistant Examiner* — Daniel L Greene
(74) *Attorney, Agent, or Firm* — Mattingly & Malur, PC

(57) ABSTRACT

There is provided an information controller (60) that calculates a work amount based on the positions of a construction target surface and a current surface in a set coordinate system set in the operational plane of a multi-joint type front work device (30), and a construction distance (L) by which a construction target surface and a current surface of configurations equivalent to those of the construction target surface and the current surface continue on a construction object, and that calculates a predicted requisite time of the work amount of a work based on the work amount and processing speed. A construction completion prediction time calculated by the information controller (60) or a prediction time calculated from the construction completion prediction time is displayed by a display device (67).

4 Claims, 11 Drawing Sheets

(56) References Cited

U.S. PATENT DOCUMENTS

| | | | | |
|---|---|---|---|---|
| 9,458,597 | B2 * | 10/2016 | Ikegami | F15B 11/17 |
| 10,006,189 | B2 * | 6/2018 | Kitajima | E02F 3/435 |
| 2003/0063779 | A1 * | 4/2003 | Wrigley | G06Q 30/02 382/116 |
| 2006/0026101 | A1 | 2/2006 | Ogura et al. | |
| 2013/0073143 | A1 * | 3/2013 | Miura | G06F 17/00 701/36 |
| 2013/0158785 | A1 * | 6/2013 | Fukano | E02F 9/261 701/34.4 |
| 2014/0100712 | A1 * | 4/2014 | Nomura | E02F 9/264 701/1 |
| 2016/0129592 | A1 * | 5/2016 | Saboo | B25J 9/1661 700/248 |
| 2017/0328030 | A1 * | 11/2017 | Yamada | E02F 9/205 |
| 2018/0218304 | A1 * | 8/2018 | Shike | G06Q 10/06313 |

FOREIGN PATENT DOCUMENTS

| | | | |
|---|---|---|---|
| JP | 3687850 | B2 | 8/2005 |
| JP | 2012-172428 | A | 9/2012 |
| WO | 2016/121010 | A1 | 8/2016 |
| WO | 2016/137017 | A1 | 9/2016 |

OTHER PUBLICATIONS

International Preliminary Report on Patentability received in corresponding International Application No. PCT/JP2017/007998 dated Mar. 28, 2019.

* cited by examiner

CONSTRUCTION MACHINE

TECHNICAL FIELD

The present invention relates to a construction machine.

BACKGROUND ART

In recent years, attention is being focused on an information-based construction technique which utilizes electronic information obtained from the construction/production processes including a survey, design, construction, supervision/inspection, and maintenance/management on construction project to realize a high efficiency and high accuracy construction. In the information-based construction technique, the electronic information obtained through construction is utilized in other processes, thus aiming to achieve an improvement in terms of productivity and securing of high quality in the whole construction production process.

For example, Patent Document 1 discloses a precision construction support system in which the construction object is imaginarily divided into a plurality of three-dimensional blocks, in which the positional coordinates of the three-dimensional blocks are used as a reference and related to the construction object information to provide a plurality of information units. Based on the information units, there is prepared three-dimensional topographic information, and the three-dimensional topographic information, the positional information on a loading machine and a transportation machine, and operational information are synthesized and analyzed before being displayed on a monitor screen. In this system, in the case where the distance between the loading machine and the transportation machine is smaller than a predetermined value and where the dwell time of the transportation machine is longer than a predetermined time, the material loaded on the loading machine is identified, and a dug-out earth amount for each material is calculated and displayed on the monitor screen.

PRIOR ART DOCUMENT

Patent Document

Patent Document 1: JP 3687850 B2

SUMMARY OF THE INVENTION

Problem to be Solved by the Invention

The prediction of each construction work by the construction machine is important from the viewpoint of construction management. According to the information-based construction technique, there is utilized three-dimensional design data prepared based on the current survey topographical data and design alignment/vertical-alignment/section data, whereby it is possible to measure the banking/cutting amount and slope face area. The banking/cutting amount and slope face area serve as a standard for the work amount, and can constitute a basis for construction time prediction.

The introduction of a construction management system utilizing three-dimensional design data, however, is not to be regarded as easy. For example, it is necessary to previously provide three-dimensional design data prepared based on the current survey topographical data and design alignment/vertical-alignment/section data, and the preparation of the three-dimensional design data takes cost and time. Further, even it is possible to measure the banking/cutting amount and slope face area, it is not easy to predict the requisite time for the completion of the construction based solely on the banking/cutting amount and slope face area since the construction work by a construction machine is wide-ranging, and the processing speed differs from work to work.

The present invention has been made based on what has been discussed above. It is an object of the present invention to make it possible to compute the construction completion prediction time for a construction machine by a simple system configuration.

Means for Solving the Problem

The present application includes a plurality of means for solving the above problem, an example of which is a construction machine including: a multi-joint type work device operating in a plane orthogonal to a width direction of the work device; and a display device displaying a construction target surface formed through work by the work device, and a forward end position of the work device with respect to the construction target surface on a screen. There is provided a controller that calculates a work amount based on positions of the construction target surface and a current surface in a coordinate system set in the plane, and on a distance by which a construction target surface and a current surface of configurations equivalent to those of the construction target surface and the current surface continue on a construction object, and that calculates a predicted requisite time of the work amount of a work based on the work amount and processing speed of the work device. The display device displays the predicted requisite time calculated by the controller or a prediction time calculated from the predicted requisite time.

Effect of the Invention

According to the present invention, it is possible to compute and display the banking/cutting amount and construction completion prediction time based on the current survey topographical data and design alignment/vertical-alignment/section data without having to prepare three-dimensional design data.

MODES FOR CARRYING OUT THE INVENTION

In the following, embodiments of the present invention will be described with reference to the drawings. To be described will be an embodiment in which a construction time prediction system according to the present invention is mounted in a hydraulic excavator.

First Embodiment

Figure 1:
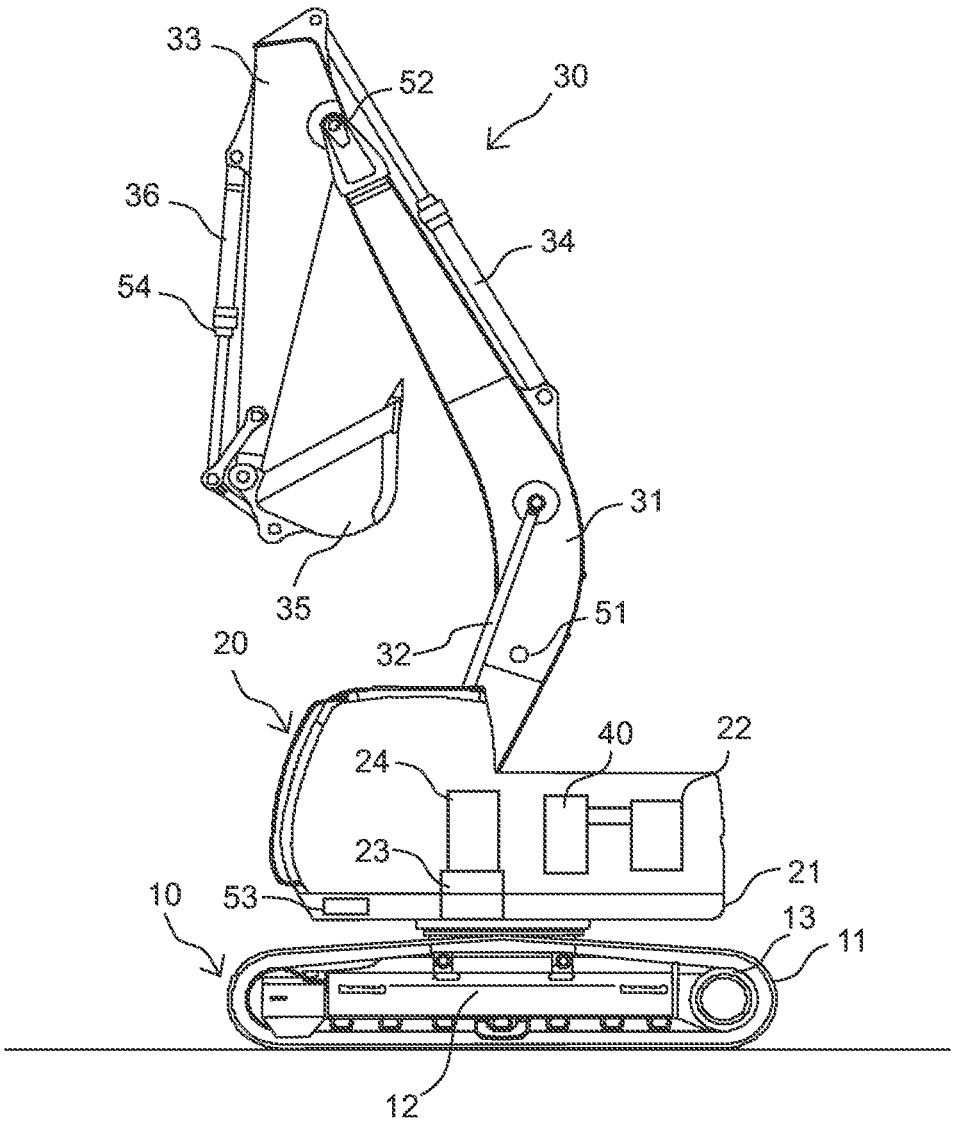
FIG. 1 is a side view of a hydraulic excavator according to an embodiment of the present invention.

FIG. 1 is a side view of a hydraulic excavator according to the first embodiment of the present invention. In FIG. 1, a lower track structure 10 is composed of a pair of crawlers 11 and crawler frames 12 (solely one of which is shown in the drawing), a pair of traveling hydraulic motors 13 (solely one of which is shown in the drawing) independently drive-controlling each crawler 11, a speed reduction mechanism thereof, etc.

An upper swing structure 20 is composed of a swing frame 21, an engine 22 as a prime mover provided on the swing frame 21, a swing mechanism 23 for swing-driving the upper swing structure 20 (swing frame 21) with respect to the lower track structure 10 by the driving force of a swing hydraulic motor 24, a cab on which an operator gets to perform operation (operation chamber), etc.

Mounted on the upper swing structure 20 is a multi-joint type front work device 30 composed of a boom 31, a boom cylinder 32 for driving the boom 31, an arm 33 rotatably supported at a portion in the vicinity of the forward end portion of the boom 31, an arm cylinder 34 for driving the arm 33, a bucket 35 rotatably supported at the forward end of the arm 33, a bucket cylinder 36 for driving the bucket 35. The boom 31, the arm 33, and the bucket 35, which are the main components of the front work device 30, operates in a plane orthogonal to the width direction of the front work device 30. The plane passes the center in the width direction of the front work device 30. In the plane, there are set an excavator reference coordinate system (UV coordinate system) and a set coordinate system (xy coordinate system). The plane is sometimes also referred to as the operational plane of the front work device 30.

Mounted on the swing frame 21 of the upper swing structure 20 are a hydraulic pump 41 generating a hydraulic pressure for driving hydraulic actuators such as a traveling hydraulic motor 13, a swing hydraulic motor 24, a boom cylinder 32, an arm cylinder 34, and a bucket cylinder 36, and a hydraulic system 40 including a control valve (not shown) for drive-controlling the actuators. The hydraulic pump 41 constituting the hydraulic fluid source is driven by the engine 22.

Mounted on the front work device 30 and the upper swing structure 20 are a boom angle sensor 51 mounted to the boom 31 in order to detect the posture of the excavator (in particular, the claw tip position of the bucket 35) and detecting a boom angle $\alpha$, an arm angle sensor 52 mounted to an arm pin and detecting an arm angle $\beta$, a machine body inclination sensor 53 mounted to the upper swing structure 20 and detecting the inclination angle $\theta$ of the upper swing structure 20 with respect to a reference surface (for example, a horizontal surface), and a bucket stroke sensor 54 for detecting a bucket angle $\gamma$ from the expansion/contraction of the bucket cylinder 36. Each angle sensor can be replaced by a stroke sensor, and the stroke sensor can be replaced by an angle sensor. Instead of the angle sensor or the stroke sensor, it is also possible to use an inclination angle sensor or an inertial measurement device.

Figure 10:
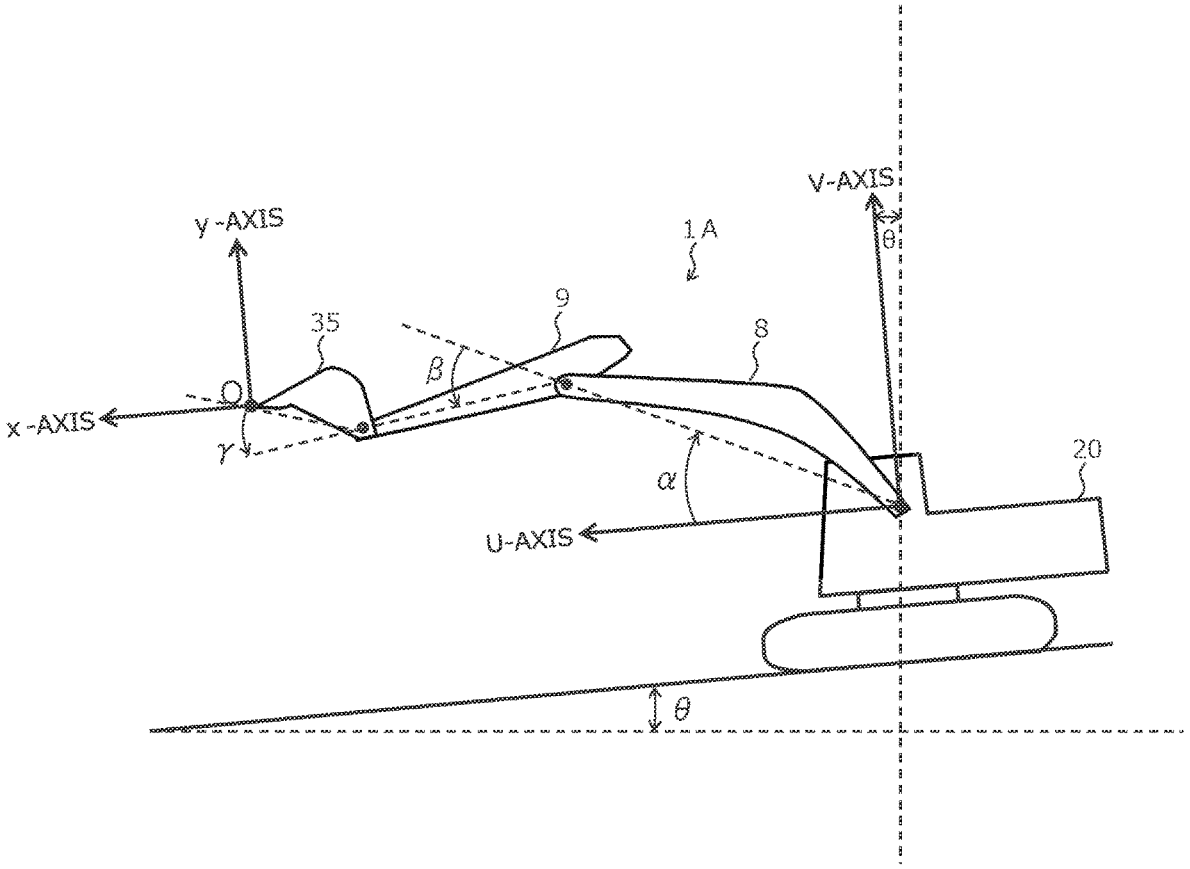
FIG. 10 is an explanatory view of a reference coordinate system and a set coordinate system.

A claw tip position computing section 62 computes the claw tip position (the posture of the work device 30) in the excavator reference coordinate system based on the output of the angle sensors 51 and 52, the inclination sensor 53, the stroke sensor 54, and the inclination sensor 53. The posture of the work device 30 can be defined based on the excavator reference coordinate system of FIG. 10. The excavator reference coordinate system of FIG. 10 is a coordinate system fixed with respect to the upper swing structure 20. The proximal portion of the boom 31 rotatably supported by the upper swing structure 20 is the origin. The V-axis is set in the vertical direction of the upper swing structure 20, and the U-axis is set in the horizontal direction of the same.

The inclination angle of the boom 31 with respect to the U-axis is the boom angle $\alpha$, the inclination angle of the arm 33 with respect to the boom is the arm angle $\beta$, and the inclination angle of the bucket claw tip with respect to the arm is the bucket angle $\gamma$. The inclination angle of the upper swing structure 20 with respect to the horizontal surface (reference surface) is the inclination angle $\theta$. The boom angle $\alpha$ is detected by the boom angle sensor 51, the arm angle $\beta$ is detected by the arm angle sensor 52, the bucket angle $\gamma$ is detected by the bucket stroke sensor 54, and the inclination angle $\theta$ is detected by the machine body inclination sensor 53. The boom angle $\alpha$ is maximum when the boom 31 is raised to the maximum (highest) degree (when the boom cylinder 32 is at the stroke end in the raising direction, that is, when the boom cylinder length is maximum), and is minimum when the boom 31 is lowered to minimum (the lowest) (when the boom cylinder 32 is at the stroke end in the lowering direction, that is, when the boom cylinder length is minimum). The arm angle $\beta$ is minimum when the arm cylinder length is minimum, and is maximum when the arm cylinder length is maximum. The bucket angle $\gamma$ is minimum when the bucket cylinder length is minimum (in the state of FIG. 10), and is maximum when the bucket cylinder length is maximum.

In the present embodiment, apart from the excavator reference coordinate system, there is used the set coordinate system. Like the excavator reference coordinate system, the set coordinate system is a coordinate system fixed with respect to the hydraulic excavator (upper swing structure 20), and uses the claw tip position (reference point) of the bucket 35 when the input device 69 including an operation switch described below is depressed as the origin. In the set coordinate system, the y-axis is set in the vertical direction of the upper swing structure 20, and the x-axis is set in the horizontal direction thereof. Arbitrary coordinates in the excavator reference coordinate system can be transformed into coordinates in the set coordinate system, and the reverse is also true.

Figure 2:
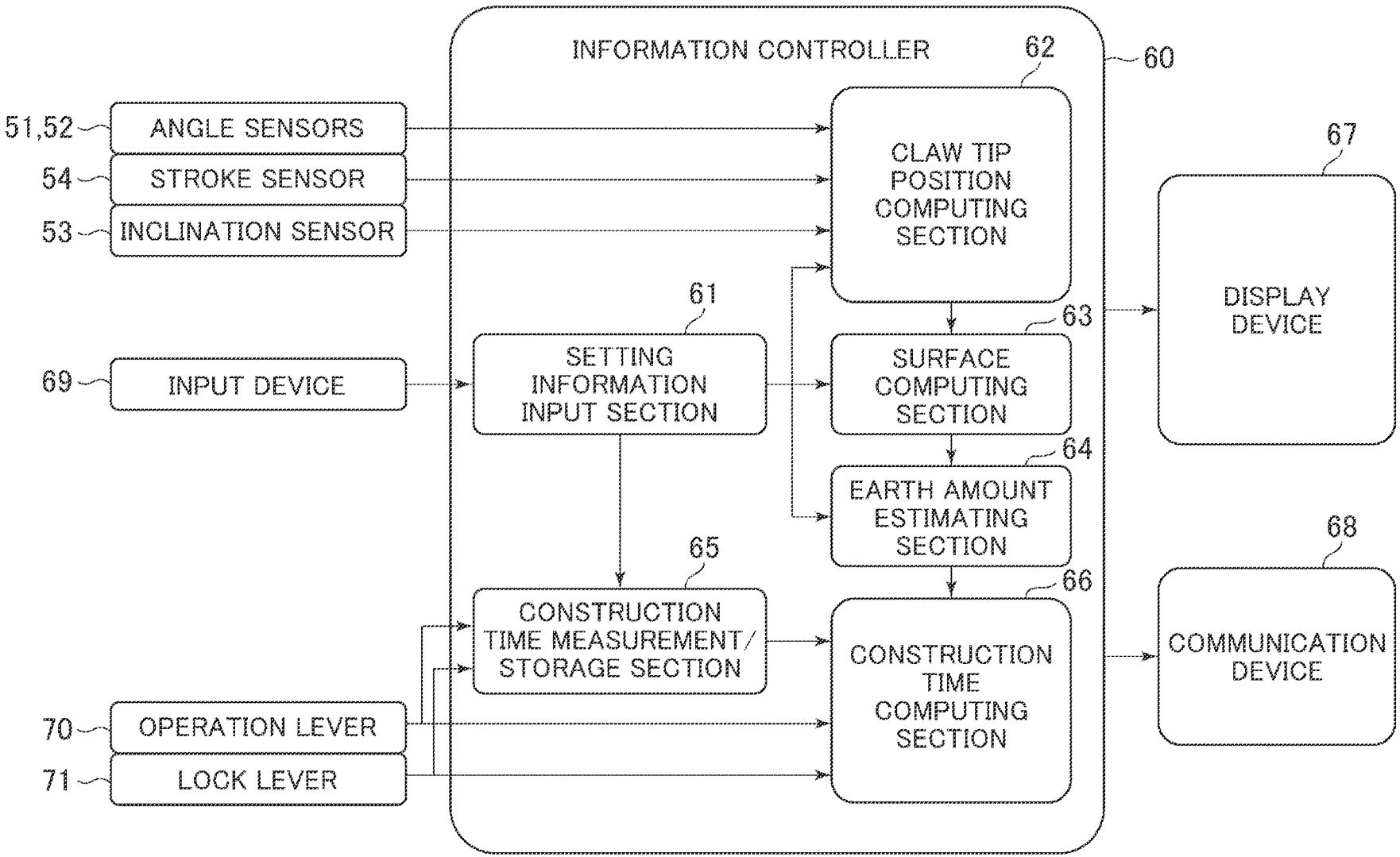
FIG. 2 is a functional block diagram illustrating an information controller according to an embodiment of the present invention.

Mounted in the cab are an operation lever (operation device) 70, a gate lock lever 71, an input device 69, a display device 67, a communication device 68, and an information controller 60 (see FIG. 2).

The operation lever 70 is used to operate each of the traveling hydraulic motor 13, the swing hydraulic motor 24, the boom cylinder 32, the arm cylinder 34, and the bucket cylinder 36, and outputs an operation signal in accordance with the operation amount the operational direction. The lock lever (also referred to as the gate lock lever) 71 is installed at the boarding gate of the cab. When the lever 71 is erected at the time of boarding, an operation signal output from the operation lever 70 is interrupted, and when the lever 72 is laid down, the operation signal is output.

The input device 69 consists of an operation switch, a numeric key pad, a touch panel, etc. This makes it possible to input various items of information from the operator to the information controller 60. The communication device 68 is a device for performing transmission/reception of information to/from an external computer. For example, a radio communication device constitutes this.

Figure 12:
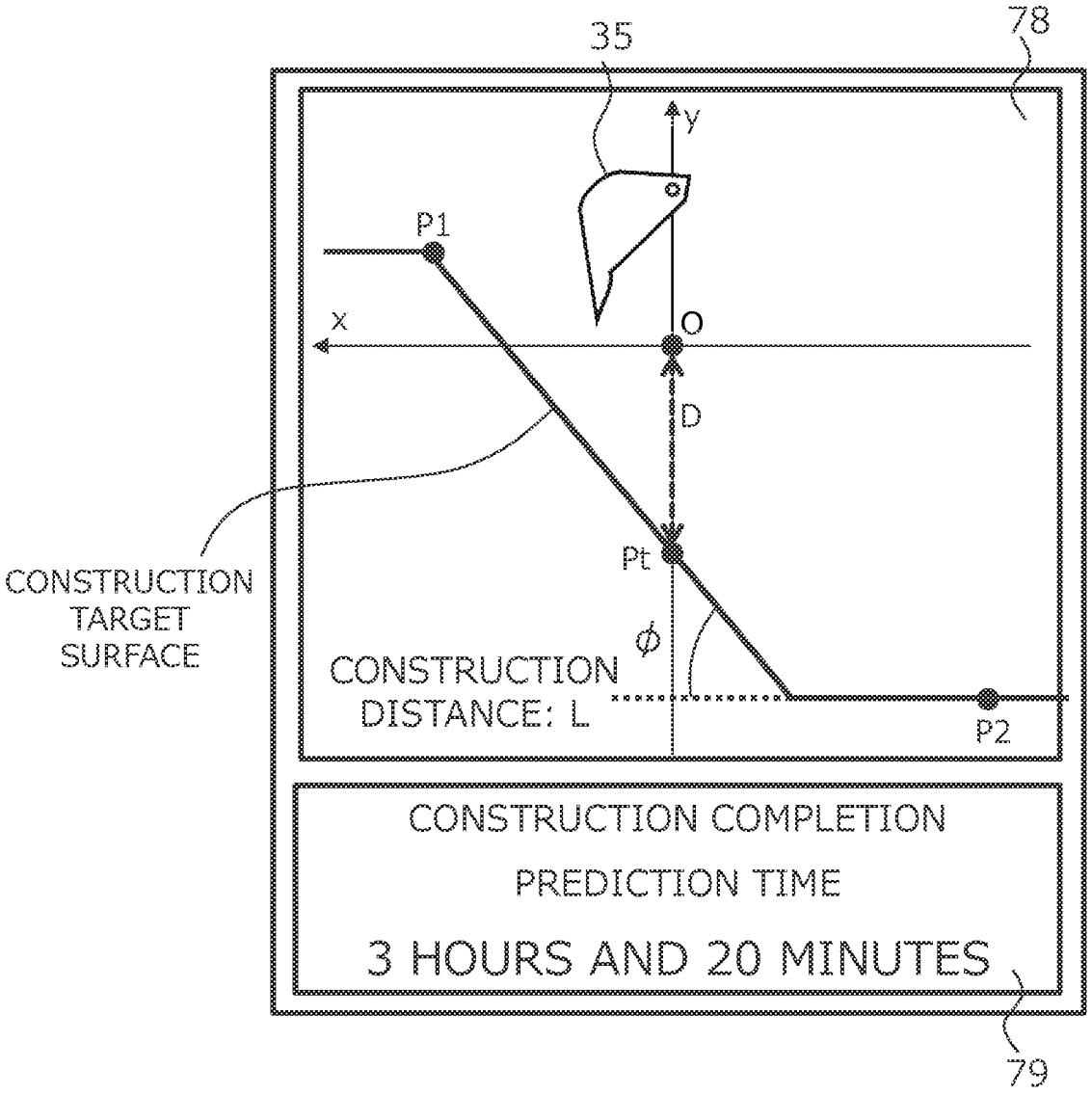
FIG. 12 is a diagram illustrating an example of a display screen of a display device.

The display device 67 is, for example, a liquid crystal monitor on which various items of information related to the hydraulic excavator and the work are displayed. For example, based on the position of the construction target surface computed by a surface computing section 63 and the position of the bucket 35 computed by a claw tip position computing section 62, there are displayed on the display device 67 the construction target surface and the position of the bucket forward end position with respect to the construction target surface as shown in FIG. 12. Due to this display, the operator can grasp whether or not the excavation object (construction object) is constructed in conformity with the construction target surface.

Figure 11:
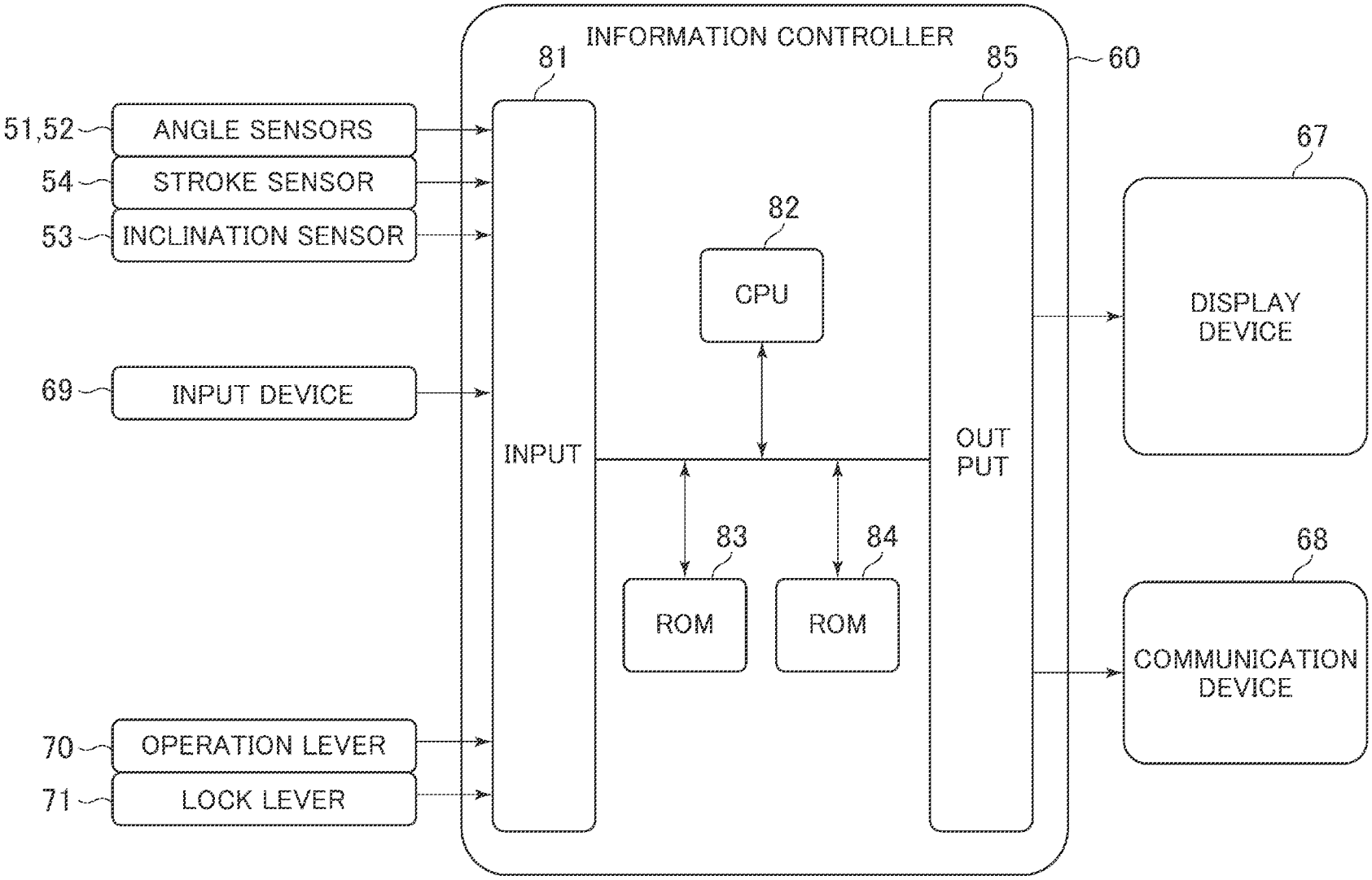
FIG. 11 is a diagram illustrating the hardware construction of an information controller according to an embodiment of the preset invention.

Next, the information controller 60 will be described. FIG. 11 shows the hardware structure of the information controller 60 which is a computer (microcomputer) mounted in the hydraulic excavator of FIG. 1. The information controller 60 has an input section 81, a central processing unit (CPU) 82 which is a processor, a read-only memory (ROM) 83 and a random-access memory (RAM) 84 which are storage devices, and an output section 85. The input section 81 inputs signals from the angle sensor 51 and 52, the inclination sensor 53, and the stroke sensor 54, a signal from the input device 69, and signals from the operation lever 70 and the lock lever 71, and performs A/D conversion. The ROM 83 is a recording medium storing a control program for executing each flowchart described below, various items of information necessary for executing each flowchart, etc., and the CPU 82 performs predetermined computation processing on the signals taken in from the input section 81, and the memories 83 and 84 in accordance with a control program stored in the ROM 83. The output section 85 prepares an output signal in accordance with the computation result at the CPU 82, and outputs the signal to the display device 67 consisting of a liquid crystal monitor or the like and the communication device 68, thereby driving/controlling the hydraulic actuators and displaying an image of the machine (the hydraulic excavator of FIG. 1), the bucket 35, the construction target surface, etc. on the screen of the display device 67. While the information controller 60 of FIG. 11 is equipped with semiconductor memories, i.e., the ROM 83 and the RAM 84 as the storage devices, they can be replaced by some other device so long as it is a storage device. For example, a magnetic storage device such as a hard disk drive may be provided.

FIG. 2 is a functional block diagram illustrating the information controller 60. The information controller 60 is equipped with a set information input section 61, a claw tip position computing section 62, a surface computing section 63, an earth amount estimating section 64, a construction time measurement/storage section 65, and a construction time computing section 66. The sections 61 through 66 may be formed as a software structure of a program stored in the ROM 83, or as a hardware structure of a circuit included in the information controller 60.

Based on the signals from the input device 69, the set information input section 61 serves to transmit various items of set information necessary for the calculation of the work amount to the sections where the items of information are required. The set information includes the position of a reference point (the position of the origin of the set coordinate system), the distance from the reference point in the y-axis direction of the set coordinate system to the construction target surface (in the following, it is sometimes referred to as the "depth D from the reference point" or "the depth D"), the angle $\emptyset$ of the construction target surface with respect to the y-axis, and the construction distance L (the distance by which the equivalent construction target surface and the current surface continue on the construction object).

Figure 3:
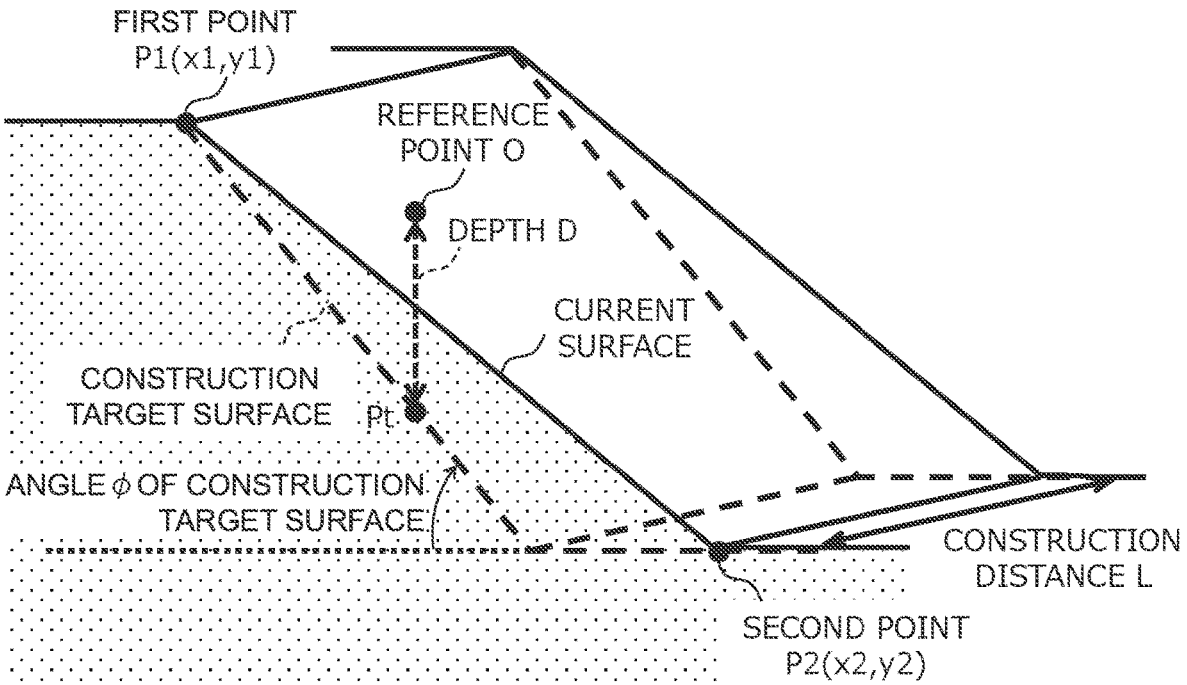
FIG. 3 is a schematic view of a construction target surface and a current surface according to a first embodiment of the present invention.

FIG. 3 shows the construction target surface, the current surface, the reference point O, the construction target surface, the depth D of the construction target surface, and the angle $\emptyset$. In FIG. 3, the shaded area is the section of the construction object by the set coordinate system (xy-plane). The first point P1 and the second point P2 on the current surface, the reference point O, and the point Pt on the section of the construction target surface exist on the section. The construction target surface means the ground surface after the construction formed through the excavation work by the front work device 30, and the current surface means the ground surface before excavation work (before construction).

The claw tip position computing section 62 computes the claw tip position of the bucket 35. Input to the claw tip position computing section 62 are the signals from the angle sensors 51 and 52, the bucket stroke sensor 54, the machine body inclination sensor 53 mounted on the front work device 30 and the upper swing structure 20, and the claw tip position determination signal from the set information input section 61. Based on these, the claw tip position of the bucket 35 is computed.

The surface computing section 63 computes the positions of the construction target surface and the current surface in the set coordinate system. The position of the construction target surface can be computed from the position of the reference point O, the depth D of the construction target surface input from the set information input section 61, and the angle $\emptyset$. The position of the current surface can be computed from the positions of two or more points on the current surface (the points P1 and P2 in the example of FIG. 3). In the present embodiment, the two or more points on the current surface are touched by the claw tip of the bucket 35, and computation is performed from the straight line passing the claw tip position at that time.

The earth amount estimating section 64 computes the work amount. The positional information on the construction target surface and the current surface computed by the surface computing section 63, and information on the construction distance L from the set information input section 61 are input to the earth amount estimating section 64. Based thereon, the estimated volume of the construction object (estimated earth amount) is computed, and the volume is regarded as the work amount.

The construction time measurement/storage section 65 stores the processing speed (work processing speed) at which the work is performed by the front work device 30. The work processing speed is the requisite time per predetermined work amount (earth amount) with respect to the work that can be conducted by the front work device 30. For example, in the following description, the excavation time per unit earth amount is the work processing speed.

The construction time computing section 66 computes the predicted requisite time (which may be referred to as "the construction completion prediction time) of the work related to the work amount calculated by the earth amount estimating section 64. The earth amount estimated by the earth amount estimating section 64 and the work processing speed of the front work device 30 stored in the construction time measurement/storage section 65 are input to the construction time computing section 66, and, based on these, the construction completion prediction time is computed. For example, the construction completion prediction time may be a value obtained by multiplying the work amount of the earth amount estimating section 64 (estimated earth amount) by the work processing speed.

In the computation of the construction completion prediction time, it is also possible to utilize the non-operation time of the front work device 30 that is computed from at least one of the signal of the operation lever 70 for conducting the operation, swinging, and traveling of the front work device 30 and the signal of the lock lever 71 ON/OFF-switch-controlling the signal of the operation lever 70. The non-operation time can be calculated from the accumulation value of the time during which there is no signal output from the operation lever 70, or the accumulation value of the time during which the lock lever 71 is at the switching position turning OFF the signal of the operation lever 70 (lock position). The non-operation time is added to the construction completion prediction time, and the construction completion prediction time is corrected, whereby it is possible to improve the accuracy in the construction completion prediction time.

The above set information and computation result are displayed on the display device (for example, the monitor in the cab) 67. Further, they are transmitted via the communication device 68 to a management system performing construction management and the like.

More specifically, there is displayed on the display device 67 the predicted requisite time (prediction time taken until the construction completion) computed by the construction time computing section 66, or the prediction time calculated from the predicted requisite time (construction completion prediction time) as the prediction time information.

As a result, based on the construction completion prediction time transmitted from each machine body operating at the work site, it is possible to estimate the requisite construction completion time and to manage the progress of the construction or the like.

As the procedures for displaying the construction completion prediction time in the construction time prediction system of the present embodiment, the following three procedures are required: 1. definition of the work amount, 2. work processing speed, and 3. calculation and display of the construction completion prediction time. In the following, each procedure will be described.

(1-1) Definition of the Work Amount

Here, the work amount means the amount of earth excavated. In the following, a method of estimating the earth amount excavated will be described. The claw tip position of the bucket 35 is computed as a relative position from the reference point O. It is computed as a point on the xy-plane (set coordinate system) having the reference point O as the origin, the x-axis that is in the front-rear direction of the excavator horizontal plane, and the y-axis that in the vertical direction in a vertical plane.

First, the operator adjusts the claw tip of the bucket 35 at the position constituting the reference point O, and inputs the setting signal through the input device 69 to thereby set the reference point O. As a result, a set coordinate system is set in the excavator.

Further, the operator sets the construction target surface. The construction target surface is determined by the depth D from the reference point O input to the set information input section 61 from the input device 69, and the surface computing section 63 to which the angle ø of the construction target surface is input.

Figure 4:
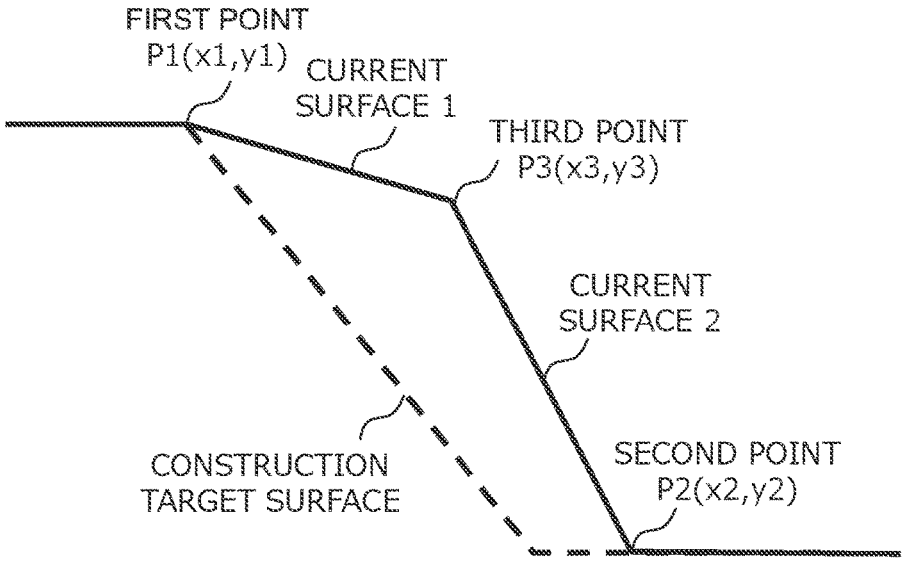
FIG. 4 is a schematic view of the construction target surface and the current surface according to the first embodiment of the present invention.

Further, the operator determines the current surface. The current surface can be determined by adjusting the claw tip of the bucket 35 to the ground before construction, and gaining the coordinates of two or more points in the set coordinate system on the ground. For example, in the case of a face-of-slope construction in a landform as shown in FIG. 3, the current surface is substantially flat, so that it is possible to determine the current surface by gaining the positions of the two points: the first point P1 and the second point P2. For example, in the case of a face-of-slope construction in a landform as shown in FIG. 4, it is possible to determine the current surface by gaining the positions of three points, i.e., in addition to the first point P1 and the second point P2, a third point P3 at a most protruding portion. It goes without saying that the current surface can also be defined by four points or more. The construction target surface and the current surface are expressed by a primary formula in the xy-plane having the reference point as the origin. When the points gained are two points, the current surface is expressed by a single primary formula, and when the points gained are three points or more, it is expressed by a plurality of primary formulas.

Further, the operator determines the construction distance L. The construction distance L is a distance, for the construction object, by which a construction target surface and a current surface of equivalent configuration to the previously determined construction target surface and current surface continue. The construction distance L may be referred to as the width of a construction object of an equivalent configuration. The construction distance L can be determined by the operator by inputting it to the set information input section 61 via the input device 69. In this case, the construction distance L is determined by man including the determination of whether or not the sectional configuration of the construction object is "equivalent."

The earth amount estimating section 64 determines the earth amount from the information on the construction target surface and the current surface and the construction distance L. The earth amount can be calculated by multiplying the integral value of the difference between the current surface and the construction target surface by the construction distance L. In performing the integration, there are respectively obtained the x value of the first point and the second point, the intersection of the current surface and the adjacent current surface in the case where there are a plurality of current surfaces, the intersection of the construction target surface and the height of the first point, the intersection of the construction target surface and the height of the second point, and the intersection of the construction target surface and the current surface. In the range of the x value of the first point and the second point, the x values are arranged in ascending order or descending order, and the integration is performed in each range. The start point and the end point of integration are respectively substituted into the related surface formulas, and the integration is performed by subtracting the formula at least one y value of which is small from the formula at least one y value of which is large. The sum total of the calculated integral values expresses the area of the earth amount in which construction is performed in the xy-plane (the set coordinate system), and the earth amount (work amount) can be calculated by multiplying this by the construction distance.

In the following, it is to be assumed that the construction of the construction object is performed, with the lower track structure 10 moving parallel to the straight line determining the construction distance L. In some cases, the plane (operational plane) in which the front work device 30 can operate, with the upper swing structure 20 and the lower track structure 10 being at rest, is referred to as the unit plane. By multiplying the area of the earth amount in which construction is performed in the xy-plane (the set coordinate system) calculated by the earth amount estimating section 64 by the width of the bucket 35, it is possible to calculate the earth amount per unit plane. Further, by dividing the excavation time per unit plane by the earth amount per unit plane, it is possible to calculate the work processing speed.

(1-2) Work Processing Speed

In the present embodiment, the construction time measurement/storage section 65 calculates the work processing speed based on the excavation time per unit plane (predicted requisite time of the work). In measuring the excavation time per unit plane, the trigger for excavation start is first input at the start of the excavation of the unit plane after the completion of the calculation of the earth amount by the earth amount estimating section 64, thus starting the measurement of the excavation time. After this, at the point in time when the excavation of the unit plane is completed, the excavation completion trigger is input, thus completing the measurement of the excavation time. From the excavation time measured and the earth amount per unit plane, it is possible to calculate the excavation time per unit earth amount, that is, the work processing speed.

It is advisable for the excavation work start/completion trigger to be input, for example, from the input device 69. Further, when the excavation work is started, the cylinder pressure of the hydraulic cylinder (e.g., the arm cylinder 34) increases. Thus, the fact that the cylinder pressure has become not less than a predetermined value may serve as the excavation work start trigger. When the excavation work of a certain unit plane has been completed, the machine travels a little to perform positional adjustment before resuming the excavation work on another unit plane. Thus, the input of the traveling operation via the operation lever 70 may serve as the excavation work completion trigger. Further, in the case where work has been executed on a similar work site, the work processing speed is stored in the construction time measurement/storage section 65 for each work site and the work, and selection is performed in conformity with the work site and the work, whereby the work processing speed measurement may be omitted.

Further, the progress of the work may be estimated from the set construction distance L and the excavator movement distance. Here, the excavator movement distance may be measured based on the change in the excavator position obtained from a GNSS (global navigation satellite system) including a GPS, or it may be obtained through estimation of the movement distance by the traveling operation from the work start.

The information controller 60 updates the work processing speed based on the requisite time for the completion of the construction of a predetermined work amount after the construction start by the front work device 30, and it is possible to calculate the predicted requisite time again from the work processing speed after the updating and the remaining work amount. This helps to achieve an improvement in terms of prediction accuracy for the predicted requisite time as well as the progress of the work.

For example, based on the progress of the work estimated as described above and the time that has elapsed from the work start, the work processing speed is updated as appropriate during the work, whereby it is possible to compute a more accurate processing speed. Further, based on the judgment by the operator or the information controller 60 or a command from the exterior, the excavation time per unit plane may be recalculated during the excavation work of a certain excavation object, thereby updating the work processing speed. Here, an example of the updating of the work processing speed by the construction time measurement/storage section 65 will be described with reference to the flowchart of FIG. 5.

Figure 5:
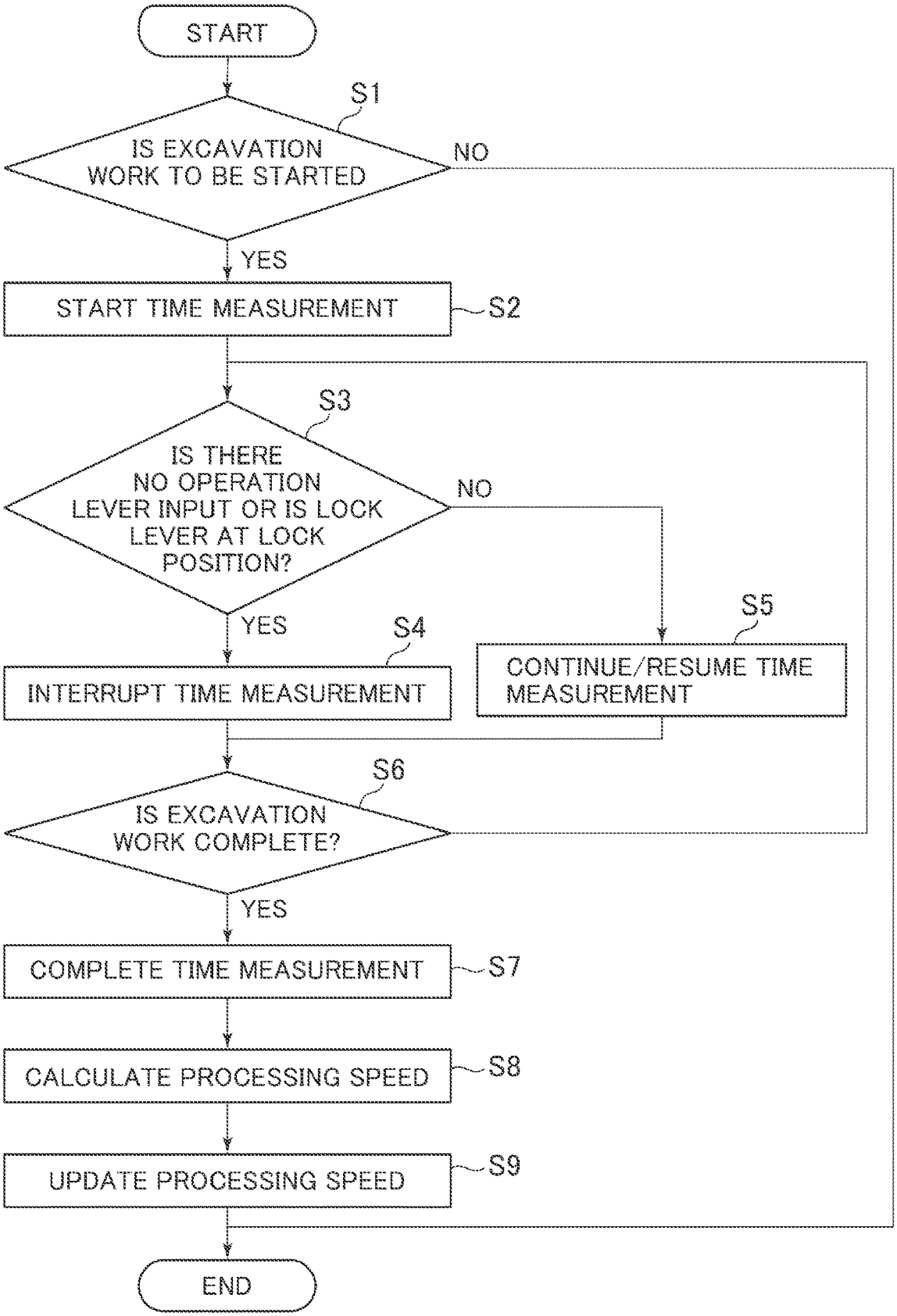
FIG. 5 is a flowchart illustrating processing speed updating according to an embodiment of the present invention.

In FIG. 5, the construction time measurement/storage section 65 determines, in step 1, whether or not the excavation work of a certain unit plane has been started based on the excavation work start trigger. The determination may be made through input by the operator from the input device 69, or based on whether or not the cylinder pressure has become not less than a fixed pressure. When it is determined that the excavation work on a unit plane has been started (Yes in step 1), the procedure advances to step 2, where time measurement is started.

In step 3, it is determined whether there is no input by the operation lever 70 or whether or not the lock lever 71 is at the lock position. When it is determined there is no input by the operation lever 70, or that the lock lever 71 is at the lock position (Yes in step 3), the procedure advances to step 4, where the time measurement is interrupted. When it is determined that there is input by the operation lever 70, and that the lock lever 71 is at the release position (the switching position where the signal of the operation lever 70 is turned ON) (No in step 3), the procedure advances to step 5, where the time measurement is continued or resumed. In the case where the time measurement is not interrupted at the pint in time of step 5, it is possible to continue the measurement as it is.

In step 6, it is determined whether or not the excavation work of the certain unit plane has been completed based on the excavation work completion trigger. The determination may be made through input from the input device 69, or may be made based on the fact that traveling operation has been input. When it is determined that the excavation work is complete (Yes in step 6), the time measurement is completed in step 7. In step 8, the processing speed is calculated based on the measurement time and the unit plane work amount of step 7, and, in step 9, the processing speed is updated to complete this flowchart.

On the other hand, when it is determined in step 6 that the excavation work is to be continued (No in step 6), the time measurement is continued, and the procedure returns to step 3.

In this way, the time measurement is continued until the completion of the excavation work. In the manner as described above, the excavation time is measured while actually performing the excavation work, and the result is reflected, whereby it is possible to calculate a more accurate processing speed. In the case where the processing speed is updated, the construction completion prediction time is recalculated based on the processing speed after the updating and the remaining work amount, and the prediction time information on the display device 67 is updated. The remaining work amount can be grasped, for example, by the above-mentioned work progress situation. That is, there is calculated the proportion of the value obtained by subtracting the excavator movement distance from the construction distance L to the construction distance L, and this is multiplied by the total work amount, whereby it is possible to grasp the remaining work amount.

(1-3) Calculation/Display of the Construction Completion Prediction Time

The construction completion prediction time can be calculated by multiplying the estimated earth amount by the excavation time per unit earth amount. The construction completion prediction time is used for the calculation of the prediction time information displayed on the display device 67. As the prediction time information, the prediction time taken until the construction completion may be displayed, or the construction completion prediction time obtained by adding the prediction time until the construction completion to the current time may be displayed.

When displaying the prediction time information, it is possible to display a time obtained through computation with a previously set break time added thereto. The construction completion prediction time starts countdown after the completion of setting or the work start time. In the case where no work is being performed, the countdown is stopped. More specifically, in the time during which the operation lever 70 is being operated, or in the case where the lock lever 71 is at the lock position, it is determined that no work is being conducted, and the countdown is stopped. In the case where setting is made so as to display the construction completion time, the time during which no work is being conducted is added to the construction completion prediction time, whereby the same result is attained.

Figure 6:
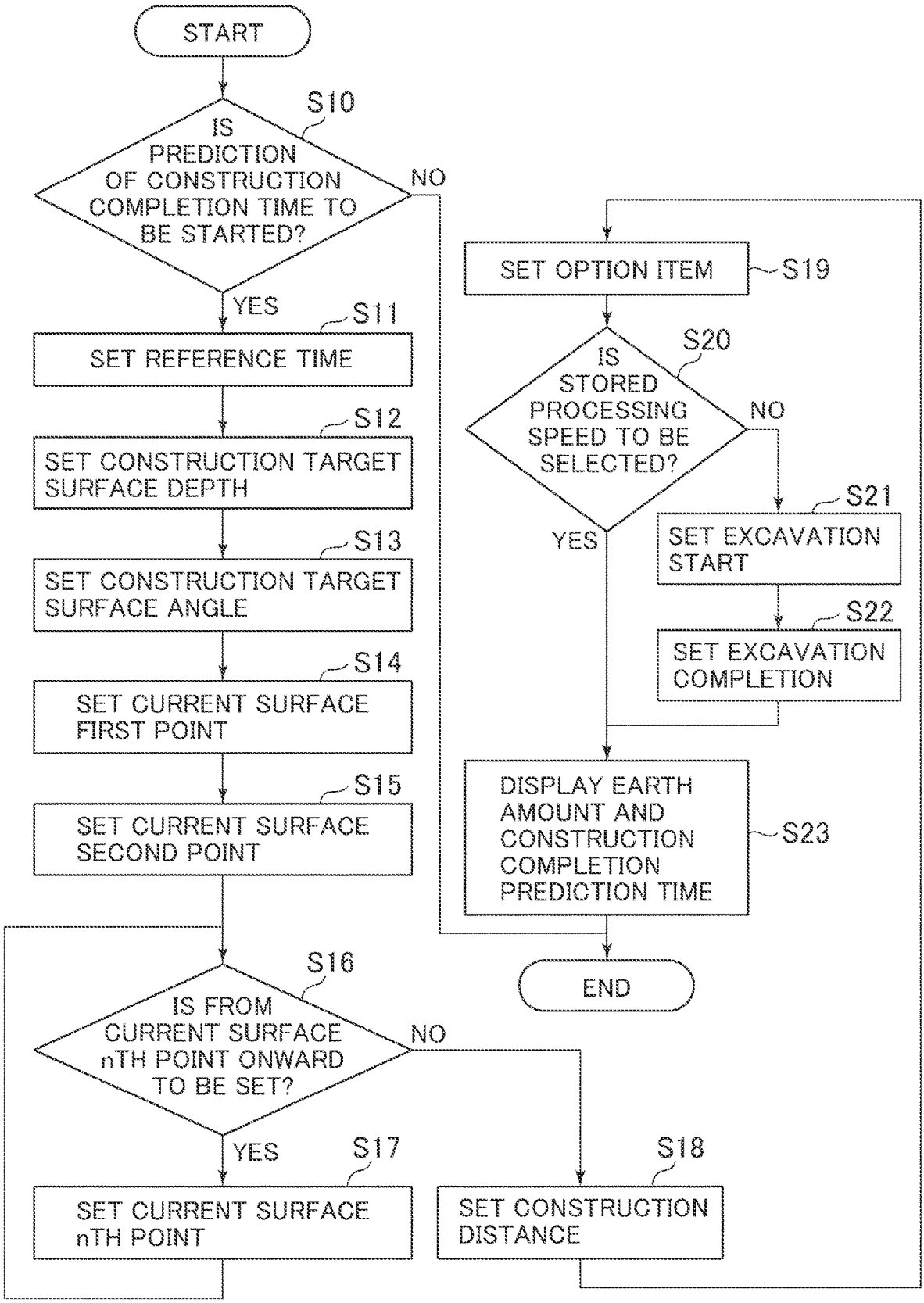
FIG. 6 is a flowchart illustrating construction completion prediction time calculation and display processing in the first embodiment of the present invention.

Next, a series of processes until the construction completion prediction time (prediction time information) is displayed on the display device 67 in the first embodiment of the present invention will be described. The information controller 60 executes processing at each section in accordance with the flowchart shown in FIG. 6, and displays the construction completion prediction time (prediction time information) on the display device 67.

First, in step 10, it is determined whether or not there is an input to start the construction completion time prediction sequence. In the case where there is no input to start the construction completion time prediction sequence (No in step 10), nothing is done. In the case where there is an input to start the construction completion time prediction sequence (Yes in step 10), the procedure advances to step 11 and from that onward.

In step 11, the reference point O is set. More specifically, the claw tip of the bucket 35 is moved to the reference point O, and there is displayed on the display device 67 a screen requiring the operator of the input to determine the reference point O. When the reference point O is set by the operator, the procedure advances to step 12.

In steps 12 and 13, the construction target surface is determined. More specifically, there is displayed on the display device 67 a screen requiring the operator of the input the depth D and the angle Ø. When the construction target surface is determined by the operator, the procedure advances to step 14.

In steps 14 through 17, the current surface is determined. First, in steps 14 and 15, there is displayed on the display device 67 a screen requiring the operator of the input to determine the first point P1 and the second point P2 on the current surface. When the two points P1 and P2 are determined, the procedure advances to step 16. In step 16, there is displayed on the display device 67 a screen asking the operator if there is the necessity of the input to determine from the third point P3 onward. In the case where there is no need to input from the third point P3 onward, the procedure advances to step 18. On the other hand, in the case where it is necessary to input points from the third point P3 onward, a desired number of points to be input is determined, and then the procedure advances to step 18.

In step 18, the construction distance L is determined. More specifically, there is displayed on the display device 67 a screen requiring the operator of the input of the construction distance L. When the construction distance L is determined by the operator, the procedure advances to step 19.

In step 19, there is displayed on the display device 67 a screen requiring the operator of the input to set the option items to be taken into consideration when the prediction time information (construction completion prediction time) is calculated and displayed in step 23 described later. Examples of the option items include which of the prediction time taken until the construction completion and the construction completion prediction time is to be displayed on the display device 67 as the prediction time information. Further, examples of the option items include whether or not to display the prediction time information taking into consideration the non-operation time (break time) based on the signals from the operation lever 70 and the lock lever 71. When the setting of the option items has been completed, the procedure advances to step 20. It is arbitrary whether or not to set the option items. The procedure may advance to step 20 without performing the setting. In this case, the option items are not reflected in the construction completion prediction time.

In step 20, there is displayed on the display device 67 a screen requiring the operator to select one work processing speed to be used for the computation of the construction completion prediction time in step 23 from among a plurality of work processing speeds stored in the construction time measurement/storage section 65. Examples of the processing speeds stored include the processing speed for each different level of skill of the operator of the construction machine, the processing speed of the work amount of the work that has been performed by the operator and for each actual value of the construction time, and the processing speed for each different work place and work. The processing speed differs for each operator and for each work place and work. When the processing speed can be thus changed for each operator and for each work place and work, it is possible to compute the construction completion prediction time more accurately.

Further, in step 20, there is executed the processing of determining whether or not a processing speed stored in the construction time measurement/storage section 65 has been selected. Here, in the case where it is determined that one has been selected (Yes in step 20), the procedure advances to step 23, and in the case where it is determined that none has been selected (No in step 20), the procedure advances to step 21 to measure the processing speed.

In steps 21 and 22, the processing speed is measured and set. In step 21, there is displayed on the display device 67 a screen requiring the operator to input the excavation work start trigger. When the operator inputs the excavation work start trigger, the processing speed measurement processing is started, and there is displayed on the display device 67 a screen requiring the operator to input the excavation work completion trigger (step 22). Here, as in the case of FIG. 5, the time required of the work completion of the unit plane is measured to obtain the processing speed. The measurement of the work time is started with the excavation work start trigger of step 21, and is completed with the excavation work completion trigger of step 22. When the excavation work completion trigger is input, the processing speed is calculated based on the measurement time and the work amount per unit plane, and the procedure advances to step 23, with the use of the processing speed for the computation of the construction completion prediction time being set. The details of the processing speed calculation processing in steps 21 and 22 are the same as those of steps 2 through 8 of FIG. 5, so a description thereof will be left out here. As the trigger in steps 21 and 22, it is possible to utilize one already described. In the case where the operation of the operation lever 70 is used as the excavation start/completion trigger, there is no need for the screen display.

In step 23, the earth amount (work amount) is computed, and, based on the earth amount and the processing speed set in step 20 or steps 21 and 22, the construction completion prediction time is computed. Then, the prediction time information computed based on the construction completion prediction time is displayed on the display device 67.

FIG. 12 shows an example of the display screen of the display device 67. The display screen of FIG. 12 is equipped with a construction target surface display section 78, and a prediction time information display section 79. The prediction time information display section 79 displays the construction completion prediction time as the prediction time information. The construction target surface display section 78 displays the construction target surface and the construction distance apart from the positional relationship between the bucket 35 and the construction target surface. In the case where the configuration information on the current surface is available, the current surface may be displayed on the construction target surface display section 78.

Based on the screen displayed for each step, the operator operates the front work device 30 and performs the value input. As a result, the prediction time information is displayed on step 23. In inputting the set information described above, selection may be made by icons or the like provided in the display device 67. Alternatively, a switch, numeric key pad, and dial may be separately provided on a console in the cab, and the input may be effected by operating them.

As described above, according to the first embodiment, there is provided a construction machine including: a multi-joint type front work device 30 operating in an operational plane orthogonal to the work device width direction (the width direction of the front work device 30); and a display device 67 displaying the positions of a construction target surface and a bucket 35 on a screen. There is provided an information controller 60 which calculates a work amount based on the positions of the construction target surface and the current surface in a set coordinate system set in the operational plane, and a construction distance L by which a construction target surface and a current surface of equivalent configurations to those of the construction target surface and the current surface continue in the construction object, and which calculates the predicted requisite time for the work based on the work amount and the processing speed. The display device 67 displays the predicted requisite time (construction completion prediction time) calculated by the information controller 60 (construction time computing section), or the prediction time calculated from the predicted requisite time.

In the above construction machine, by defining the construction target surface and the current surface in the set coordinate system and inputting the construction distance L, it is possible to calculate/display the volume of the construction object (the earth amount in the case where the construction object is banking/cutting). Further, by setting the processing speed, the requisite time for the construction completion of the construction object (predicted requisite time) can be easily calculated/displayed based on the volume of the construction object and the processing speed. As a result, it is possible for the construction machine at the construction site to compute and display the banking/cutting amount and the construction completion prediction time easily and singly based on the current survey topographical data and the design alignment/vertical-alignment/section data without having to prepare three-dimensional design data.

In particular, in the above example, it is possible to set the construction target surface and the current surface based on the claw tip position of the bucket 35 with respect to the coordinate system (set coordinate system) fixed to the excavator, so that there is no need to prepare the three-dimensional design data, and it is possible to easily estimate the excavation earth amount.

Further, in the above construction machine, the information controller 60 updates the processing speed based on the requisite time for construction completion of a predetermined work amount (e.g., the work amount per unit plane) after the construction start by the front work device 30, and can calculate the predicted requisite time from the processing speed after the updating and the remaining work amount. In particular, in the excavation work by the hydraulic excavator, the work is repeated per unit plane, so that the updating of the processing speed per unit plane is easy. Further, the same work is repeated for each unit plane, so that the operator gets easily accustomed to the work, and an improvement in terms of processing speed is easy to achieve. In view of this, by updating the processing speed based on the time needed for the construction completion of the work amount per unit plane, it is possible to easily achieve an improvement in terms of the accuracy in the predicted requisite time.

Second Embodiment

Next, the second embodiment of the present invention will be described. The second embodiment is of a structure similar to that of the first embodiment. In the following, the differences will be described.

(2-1) Definition of the Work Amount

In the second embodiment, two work amounts are defined. More specifically, the rough excavation earth amount and the finish excavation earth amount are defined. This is due to the fact that the speed of the excavation at a position far from the target surface (rough excavation) and the speed of the excavation at a position near the target surface (finish excavation) differ from each other owing to the difference in the natures of these excavation works. The method of setting the construction target surface and the current surface is the same as that of the first embodiment.

Figure 7:
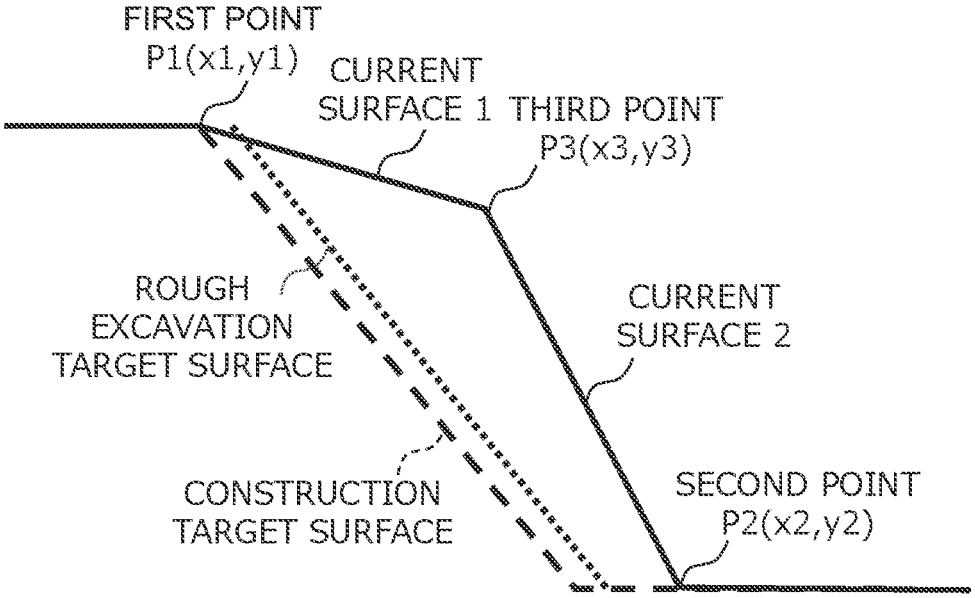
FIG. 7 is a schematic diagram illustrating a construction target surface, a rough excavation target surface, and a current surface according to a second embodiment of the present invention.

Here, as shown in FIG. 7, the rough excavation target surface is set at a predetermined height from the construction target surface, for example, at a height position of 20 cm. The rough excavation target surface is the boundary between the rough excavation work and the finish excavation work, and can be different from operator to operator. The sum total of the integral values of the difference between the current surface and the rough excavation target surface expresses the area of the rough excavation earth amount with which the construction is performed in the xy-plane, and, by multiplying this by the construction distance, it is possible to calculate the rough excavation earth amount. The sum total of the integral values of the difference between the rough excavation target surface and the construction target surface expresses the area of the finish excavation earth amount with which the construction is performed in the xy-plane, and, by multiplying this by the construction distance, it is possible to calculate the finish excavation earth amount.

The rough excavation target surface is previously determined to be of a fixed height from the construction target surface, for example, 20 cm, so that the calculation of the finish excavation earth amount may be simplified. That is, by multiplying the length of the construction target surface by the height from the construction target surface, which is 20 cm in this example, the area of the finish excavation earth amount can be simply calculated. By multiplying this by the construction distance, it is possible to calculate the finish earth amount. In the case where the finish excavation earth amount is calculated in this way, the rough excavation earth amount can be calculated by subtracting the finish excavation earth amount from the entire earth amount calculated from the current surface and the construction target surface.

(2-2) Work Processing Speed

In the present embodiment, to conform to the above definition of the work amount, the rough excavation processing speed (rough excavation time per rough excavation earth amount) and the finish excavation processing speed (finish excavation time per finish excavation earth amount) are stored in the construction time measurement/storage section 65. The rough excavation processing speed can be calculated from the average value of the requisite time for a series of rough excavation operations (a series of operations from the rough excavation start to the next rough excavation start via the earth discharge), and the average value of the earth amount loaded in the bucket 35. Similarly, the finish excavation processing speed can be calculated from the average value of the requisite time for a series of finish excavation operations, and the average value of the earth amount loaded in the bucket 35. The amount of earth loaded in the bucket 35 varies depending on the kind of the bucket 35, so that in the case where the bucket 35 is changed, it is desirable to change the set value of the loaded earth amount in accordance with the kind of the bucket 35. Regarding these excavation times, the value for a standard operator may be stored, or a set value may be provided for selection for each level of the years of experience and skill of the operator. Further, it is also possible to measure the time of each of a series of work operations, and to cause the average value to be reflected. This makes it possible to compute a more accurate work processing speed. In this way, in the second embodiment, it is possible to set the work processing speed without executing the measurement of the excavation time per unit plane.

(2-3) Calculation/Display of the Construction Completion Prediction Time

The method of calculating/displaying the construction completion prediction time is similar to that of the first embodiment of the present invention.

Next, a series of processes until the construction completion prediction time (prediction time information) is displayed on the display device 67 in the second embodiment of the present invention will be described. In accordance with the flowchart of FIG. 8, the information controller 60 executes processing at each section, and displays the construction completion prediction time (prediction time information) on the display device 67. In the following, the differences of the present embodiment form the first embodiment will be described.

In step 24, which is subsequent to the processing for determining the construction target surface (steps 12 and 13), in order to determine the rough excavation surface, there is displayed on the display device 67 a screen requiring the operator to input the rough excavation height. When the rough excavation surface is determined by the operator, the procedure advances to step 14.

In step 25, there is displayed on the display device 67 a screen requiring the operator to select one work processing speed to be used for the completion of the construction completion prediction time in step 23 from among a plurality of work processing speeds stored in the construction time measurement/storage section 65. As in the first embodiment, when the work processing speed is selected by the operator, there is displayed on the display device 67 a screen requiring the operator to input the option item setting to be taken into consideration when calculating/displaying the prediction time information (construction completion prediction time) in step 23. When the setting of the option items is complete, the procedure advances to step 23. The option item setting is optional. In the case where there is no option item setting, the option items are not reflected in the construction completion prediction time.

As described above, in the second embodiment, the rough excavation earth amount and the finish excavation earth amount are easily estimated. By setting the rough excavation time per unit earth amount and the finish excavation time per unit earth amount, it is possible to compute the construction completion prediction time and to display it on the display device 67. As a result, it is possible for the construction machine on the work site to singly compute and display the banking/cutting amount and the construction completion prediction time.

There is a difference in processing speed between the rough excavation work and the finish work. Further, the two processing speeds vary from operator to operator. For example, depending on the operator, there are cases where the rough excavation work is quicker than the average and where the finish work is slower than the average. Further, the depth of the rough excavation target surface often varies depending on the operator. Thus, it is sometimes difficult to accurately grasp the accurate work progress with the processing speed at the unit plane of the first embodiment alone. However, when, as in the present embodiment, the construction completion prediction time is computed by utilizing the processing speed differing between the rough excavation work and the finish work, it is possible to accurately grasp the work progress.

Third Embodiment

Next, the third embodiment of the present invention will be described. In the following, the differences of the present embodiment from the first and second embodiment will be described, and a redundant description will be left out.

(3-1) Definition of the Work Amount

As the work amount, in addition to the earth amount of the first embodiment of the present invention, there is utilized the length of the construction target surface in the set coordinate system used when the earth amount is defined. When the angle of the construction target surface is 0°, the length of the construction target surface can be calculated from the difference in the x-coordinate between the first point and the second point on the current surface. When the angle of the construction target surface is 90°, the length of the construction target surface can be calculated from the difference in the y-coordinate between the first point and the second point on the current surface. In the other cases, it can be calculated, in a right-angled triangle the hypotenuse of which constitutes the construction target surface, from the two sides at right angles obtained from the difference between the first point and the second point on the current surface by using the Pythagorean theorem.

(3-2) Work Processing Speed

In the present embodiment, to conform to the above definition of the work amount, the normal excavation processing speed (excavation time per unit earth amount) and the finish surface excavation processing speed (finish time per unit length of the construction target surface) are stored in the construction time measurement/storage section 65. The excavation time per unit earth amount can be calculated from the average value of the requisite time for a series of excavation operations (a series of operations from the excavation start to the next excavation start via the earth discharge), and the average value of the earth amount loaded in the bucket 35. The finish time of the construction target surface per unit length can be calculated from the average value of the requisite time for the finish work of the construction target surface per unit length. Otherwise, the present embodiment is the same as the second embodiment.

(3-3) Calculation/Display of the Construction Completion Prediction Time

The construction completion prediction time can be calculated by adding together the excavation time, which is calculated by multiplying the earth amount by the excavation time per unit earth amount, and the finish time, which is calculated by multiplying the length of the construction target surface by the finish time per unit length. Except for the calculation of the construction completion prediction time, the present embodiment is the same as the first embodiment of the present invention.

Figure 8:
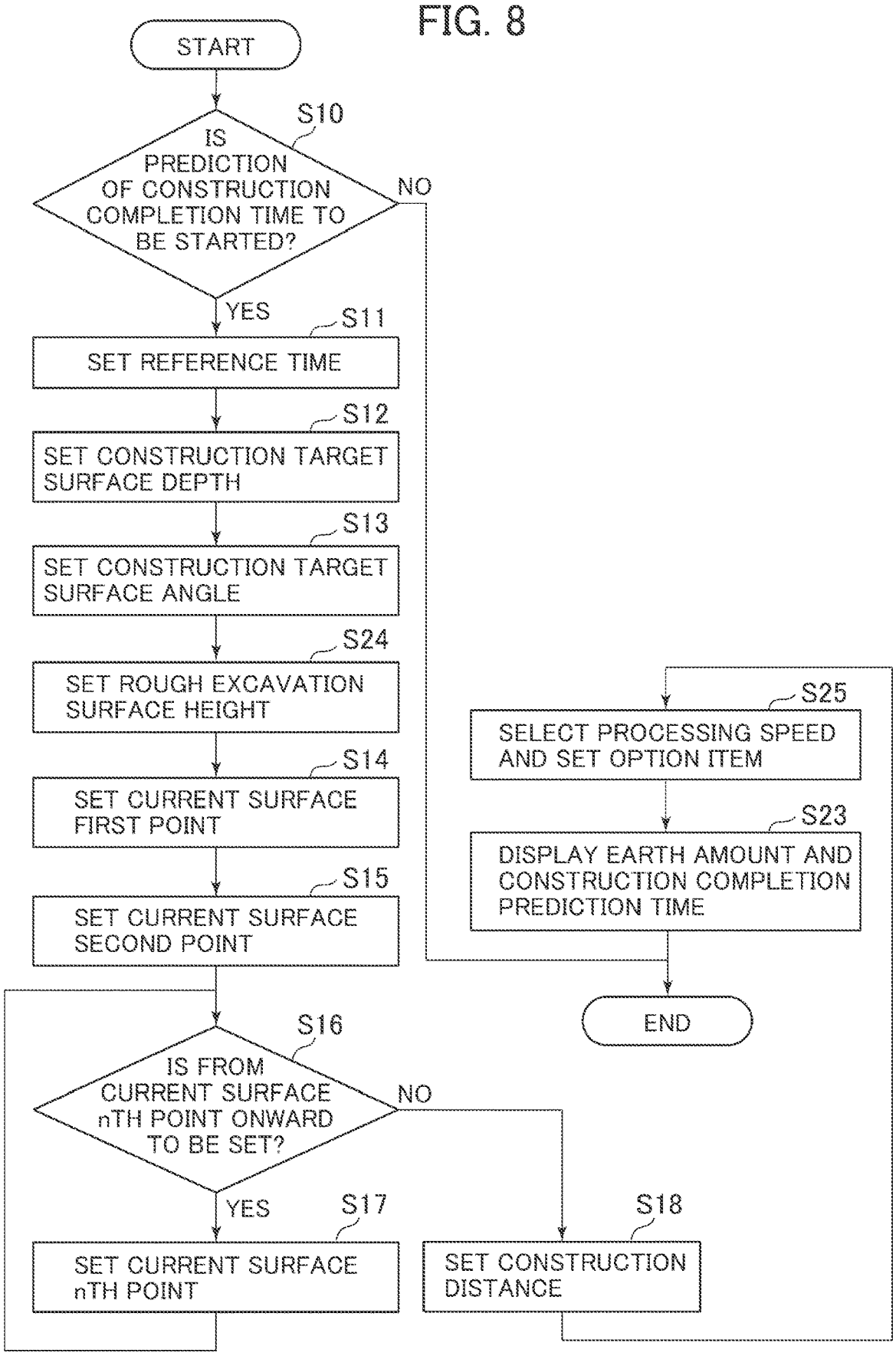
FIG. 8 is a flowchart illustrating construction completion prediction time calculation and display processing in the second embodiment of the present invention.
Figure 9:
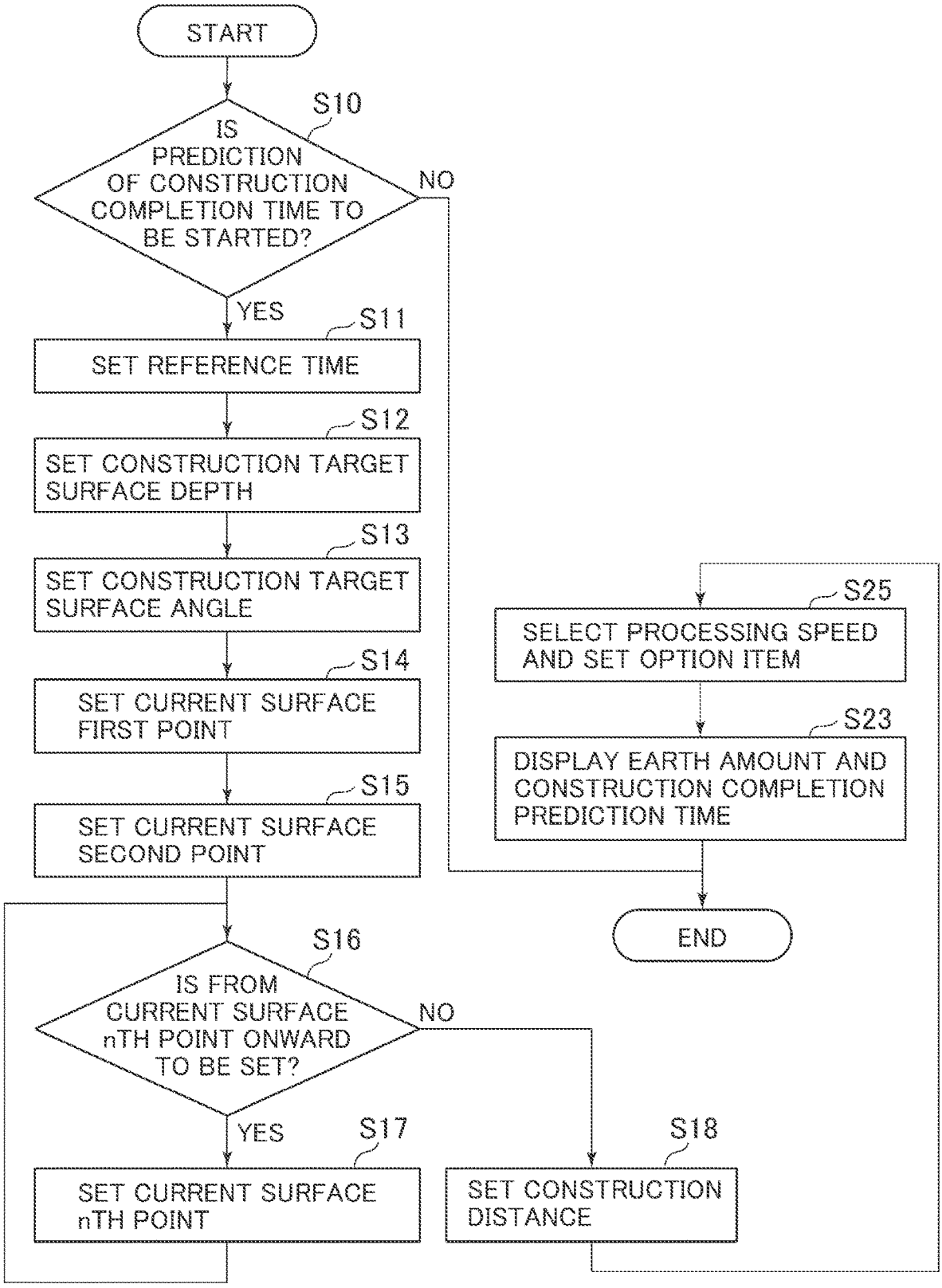
FIG. 9 is a flowchart illustrating construction completion prediction time calculation and display processing in a third embodiment of the present invention.

Next, to be described will be a series of processes until the construction completion prediction time (prediction time information) is displayed on the display device 67 in the third embodiment of the present invention. The information controller 60 executes processing at each section in accordance with the flowchart shown in FIG. 9, and displays the construction completion prediction time (prediction time information) on the display device 67. The flowchart of the third embodiment is substantially the same as that of the second embodiment shown in FIG. 8. Only, step 24 of FIG. 8 is not needed.

As described above, in the third embodiment, the excavation earth amount and the finish surface length are easily estimated, and the excavation time per earth amount and the finish time per finish surface length are set, whereby it is possible to compute the construction completion prediction time and display it on the display device 67. In particular, in the third embodiment, it is possible to predict the construction completion time without setting the rough excavation target surface as in the second embodiment, or estimating the two earth amounts of the rough excavation earth amount and the finish excavation earth amount.

[Additional Remark]

For the determination of the construction target surface, the angle ø is not always necessary. The determination is also possible in the case where the depths from a plurality of arbitrary points to the construction target surface are known. In this case, the claw tip is moved to each point, and the depth is input in this posture from the input device 69, whereby it is possible to define the construction target surface in the set coordinate system.

In determining the current surface, the points P1 and P2 at both ends of the current surface are input in the above example. This, however, should not be construed restrictively. The determination is possible when two or more points on the surface are input. In this case, setting can be made such that the lower end of the current surface is automatically set at the intersection of the straight line determined by two or more points input through the bucket claw tip and the straight line of the installation surface of the excavator. Further, while in the above example the reference point O, etc. are determined by using the bucket claw tip as the reference (control point), it is also possible to set a point on the bucket 35 other than the claw tip or an arbitrary point including a point on the work device 30 as the control point.

The work processing speed may be updated based on the requisite time for the construction completion of the predetermined work amount after the construction start by the front work device 30. The predicted predetermined time may be calculated from the work processing speed after the updating and the remaining work amount.

In the above examples, there is first set a set coordinate system using an arbitrary point as the origin (reference point O), and the construction target surface and the current surface are set in the coordinate system. The construction target surface and the current surface may be previously set in a coordinate system using a certain point of the work site as the origin (reference point O), and the bucket claw tip may be moved to the certain point to set the coordinate system in the excavator to compute and display the construction completion prediction time.

The processes of the flowcharts of FIGS. 5, 6, 8, and 9 may be interchanged as appropriate so long as the construction completion prediction time computation result is the same. Further, the processing speed updating processing described with reference to FIG. 5 is also applicable to the second embodiment and the third embodiment.

The earth amount and the construction completion prediction time calculated in the above embodiments may be transmitted to an external computer by a communication device such as a radio communication device mounted in the hydraulic excavator. Further, the calculation of the earth amount and the construction completion prediction time may be conducted through dispersion processing by a plurality of controllers (computers) mounted in the hydraulic excavator, or it may be conducted by an external computer.

While in the above three embodiments the definition of the work amount is conducted on the work site for each construction machine, it is also possible to previously prepare three-dimensional design data based on the current measurement topographical data, and the alignment/vertical-alignment/section data of the design, and to define the work amount. Further, while in the three embodiments of the present invention described above the work processing speed is computed for each construction machine, the work processing speed may be computed on the construction management side from the construction machine operating condition and the work progress, reflecting the computation result in each construction machine.

The present invention is not restricted to the above embodiments but includes various modifications without departing from the scope of the gist of the invention. For example, the present invention is not restricted to a structure equipped with all the components described above in connection with the above embodiments. Part of the components may be deleted. Further, a part of the structure of a certain embodiment may be added to or replace the structure of another embodiment.

DESCRIPTION OF REFERENCE CHARACTERS

10: Lower track structure
11: Crawler
12: Crawler frame
13: Left traveling hydraulic motor
14: Right traveling hydraulic motor
20: Upper swing structure
21: Swing frame
22: Engine
23: Swing mechanism
24: Swing hydraulic motor
26: Monitor
30: Front work device
31: Boom
32: Boom cylinder
33: Arm
34: Arm cylinder
35: Bucket
36: Bucket cylinder
40: Hydraulic system
41: Hydraulic pump
51: Boom angle sensor
52: Arm angle sensor
53: Machine body inclination sensor
54: Bucket stroke sensor
60: Information controller
61: Set information input section
62: Claw tip position computing section
63: Surface computing section
64: Earth amount estimating section
65: Construction time measurement/storage section
66: Construction time computing section
67: Display device
68: Communication device
69: Input device
70: Operation lever
71: Lock lever

The invention claimed is:

1. A construction machine comprising:

a work device having a boom, an arm, and a bucket operating in a plane orthogonal to a width direction of the work device;

an upper swing structure on which the work device is mounted;

a plurality of angle sensors each detecting angles of the boom, the arm, and the bucket, and an inclination angle of the upper swing structure with respect to a reference surface; and a display device displaying a construction target surface formed through work by the work device, and a forward end position of the work device with respect to the construction target surface on a screen, the construction machine further comprising:

a controller that calculates a work amount based on positions of the construction target surface and a current surface in a coordinate system set in the plane, and based on a construction distance which is a width of a construction object determined by the operator of the specification, the construction distance being the width by which a construction target surface and a current surface of equivalent configurations to those of the construction target surface and the current surface continue on the construction object, and that calculates a predicted requisite time based on the work amount and a processing speed of the work device; and an input device through which data for the controller including the construction distance is input by an operator, wherein the display device displays screens requesting the operator to input operations through the input device that determine the current surface and requesting the operator to input the construction distance through the input device, the controller includes:

a position computing section computing a forward end position of the work device in the coordinate system on the basis of signals from the plurality of angle sensors;

a surface computing section computing a position of the current surface from positions of two or more points on the current surface computed by the position computing section when the two or more points on the current surface are touched by a forward end of the work device and when the operations that determine the current surface are input through the input device by the operator;

an earth amount estimating section calculating the work amount based on the position of the construction target surface, the position of the current surface computed by the surface computing section, and the construction distance input from the input device;

a construction time measurement/storage section storing a processing speed of the work device; and a construction time computing section computing the predicted requisite time based on the work amount estimated by the earth amount estimating section and the processing speed stored in the construction time measurement/storage section, and the display device displays the predicted requisite time calculated by the construction time computing section or a prediction time calculated from the predicted requisite time.

2. The construction machine according to claim 1, wherein after construction start by the work device, the controller updates the processing speed based on a requisite time for construction completion of a predetermined work amount, and calculates the predicted requisite time from the processing speed after the updating and a remaining work amount.

3. The construction machine according to claim 1, wherein, as the processing speed, it is possible to select a value in accordance with a skill of an operator of the construction machine, or actual values of a work amount and a construction time of a work that has been conducted by the operator.

4. The construction machine according to claim 1, wherein the controller corrects the predicted requisite time by adding a non-operation time of the work device.

* * * * *